US006427588B1

(12) United States Patent
Kline

(10) Patent No.: US 6,427,588 B1
(45) Date of Patent: Aug. 6, 2002

(54) DEVICE AND METHOD FOR SUPPORTING AND TENSIONING A SILK SCREEN

(76) Inventor: Christopher Kline, 4375 June Meadow Dr., Doylestown, PA (US) 18901

( * ) Notice: Subject to any disclaimer, the term of this patent is extended or adjusted under 35 U.S.C. 154(b) by 0 days.

(21) Appl. No.: 09/655,432

(22) Filed: Sep. 5, 2000

(51) Int. Cl.[7] ..... B41F 15/34; B41F 15/36
(52) U.S. Cl. ..... 101/127.1; 101/127
(58) Field of Search ..... 101/127.1, 128.1, 101/114, 115, 128.4, 129, 127

(56) References Cited

U.S. PATENT DOCUMENTS

| | | | | |
|---|---|---|---|---|
| 3,482,343 A | * | 12/1969 | Hamu | 101/127.1 |
| 3,485,165 A | | 12/1969 | Hughes | 101/127.1 |
| 3,553,862 A | | 1/1971 | Hamu | 38/102.1 |
| 3,601,912 A | | 8/1971 | Dubbs | 38/102.91 |
| 5,076,162 A | * | 12/1991 | Goin | 101/127.1 |
| 5,113,611 A | * | 5/1992 | Rosson | 101/127.1 |
| 5,265,534 A | * | 11/1993 | Hamu | 101/127.1 |
| 5,271,171 A | * | 12/1993 | Smith | 101/127.1 |
| 5,802,971 A | | 9/1998 | Hamu et al. | 101/127.1 |
| 5,937,751 A | | 8/1999 | Newman, Jr. | 101/127.1 |

* cited by examiner

*Primary Examiner*—Daniel J. Colilla
(74) *Attorney, Agent, or Firm*—LaMorte & Associates

(57) ABSTRACT

A frame assembly for use in supporting a silk screen. The assembly uses four corner brackets in forming the frame. The corner brackets each contain two perpendicular arms. The corner brackets engage four framing elements, thereby forming the rectangular structure of the frame. Each of the framing elements has two ends, wherein each end of a framing element receives one of the corner bracket arms. As such, each of the four corner brackets engages two of the framing elements and orients those elements at a perpendicular. An adjustment mechanism is disposed between each end of the framing elements and each of the corner brackets. The adjustment mechanism adjusts how deep an arm from a corner bracket is received within an end of a framing element. By utilizing the adjustment mechanism, the effective length of each of the sides of the frame can be selectively adjusted.

9 Claims, 4 Drawing Sheets

DEVICE AND METHOD FOR SUPPORTING AND TENSIONING A SILK SCREEN

BACKGROUND OF THE INVENTION

1. Field of the Invention

The present invention relates to frame assemblies that are used to support and stretch silk screens for use in a silk screen printing process.

2. Description of the Prior Art

In the many years since their invention, silk screen printing techniques have been used to print images on a wide variety of objects. Today, silk screen printing is the printing method of choice for printing on fabric such as tee shirts, sweat shirts, jackets, hats and the like.

In the silk screening process, a negative of an image is etched into a coated piece of silk screen. The etched silk screen is then placed upon the surface to be printed. Ink is then pressed through the silk screen. The ink passes through the silk screen in the places where the coating has been etched. The result is a positive rendition of the etched negative being reproduced in ink on the surface that was placed against the silk screen.

Prior to a silk screen being placed against a piece of fabric, the silk screen must be suspended in a frame so that the silk screen remains in a fixed position. Once in the frame, the silk screen must also be stretched to remove any slack in the screen that could wrinkle when the ink is pressed through the screen. Not only must a silk screen be tensioned, it must be evenly tensioned in all directions. If a silk screen is not evenly tensioned the image etched on the silk screen will be distorted and consequently the image reproduced from the silk screen will also be distorted.

Over the years many different types of silk screen frames have been produced. A popular type of silk screen frame uses a rectangular frame where a roller is positioned along each side of the frame. The side edges of a rectangular silk screen are connected to the rollers and the rollers are rotated to apply an even tension to the silk screen. Such prior art silk screen frames are exemplified by U.S. Pat. No. 5,937,751 to Newman, entitled, Retensionable Screen Frame And Stretchers; U.S. Pat. No. 5,802,971 to Hamu, entitled Screen Printing Frame Assembly With Screen Anchors; and U.S. Pat. No. 3,601,912 to Dubbs, entitled Woven Screen Stretching Frame.

A problem associated with screen frames having rollers is that it is very difficult to position a silk screen in the same location on the frame after the silk screen has been removed. As such, there are small variations that occur in the image being printed each time the same silk screen is tensioned in such a frame.

In an attempt to make the accurate loading and unloading of silk screens a more repeatable process, frames have been developed that do not use rollers. In such prior art frames, an adjustable slide mechanism is constructed into each frame element. The slide mechanisms typically can move about one inch within the confines of the frame. This enables each edge of the silk screen to be adjusted within the one inch range. Since the silk screen is mechanically attached to the various slides, the exact point of attachment between the silk screen and the frame can be more precisely controlled. Since the placement of the silk screen on the frame can be better controlled, the accuracy of the placement is increased. Such prior art frame assemblies are exemplified by U.S. Pat. No. 3,385,165 to Hughes, entitled Adjustable Stretch Frame For Biaxially Stressing Sheet Material.

A problem with all of the silk screen frames previously described is that the size of the actual frame is fixed. Silk screens come in a variety of different shapes and sizes. In the past, if a particular silk screen was too large or too small for a frame, that frame had to be replaced with one that was an appropriate size.

A need therefore exists for an improved silk screen frame that has a modular construction that allows the frame to be widely adjusted in size. The improved frame also requires the ability to accurately place silk screens within the frame, time after time. These needs are met by the present invention as is described and claimed below.

SUMMARY OF THE INVENTION

The present invention is a frame assembly for use in supporting a silk screen. The assembly uses four corner brackets in forming the frame. The corner brackets each contain two perpendicular arms. The corner brackets engage four framing elements, which make up the sides of the completed frame. Each of the framing elements has two ends, wherein each end of a framing element receives one of the corner bracket arms. As such, each of the four corner brackets engages two of the framing elements and orients those elements at a perpendicular. The use of four framing elements joined by four corner brackets therefore results in a rectangular or square frame.

An adjustment mechanism is disposed between each end of the framing elements and each of the corner brackets. The adjustment mechanism adjusts how deep an arm from a corner bracket is received within an end of a framing element. By utilizing the adjustment mechanism, the effective length of each of the sides of the frame can be selectively adjusted. Accordingly, a silk screen being mounted to the frame can be pulled taut in a highly accurate and repeatable manner.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE INVENTION

Although the present invention device can be used to tension many types of materials, such as painting canvas, needlepoint backing and the like, the present invention device is particularly well suited for retaining silk screens of the type used in silk screen printing. Accordingly, an exemplary embodiment of the present invention is described below that shows the present invention used to retain a silk screen. It will be understood that this embodiment is merely exemplary and is presented only to represent the best mode contemplated for the present invention.

Figure 1:
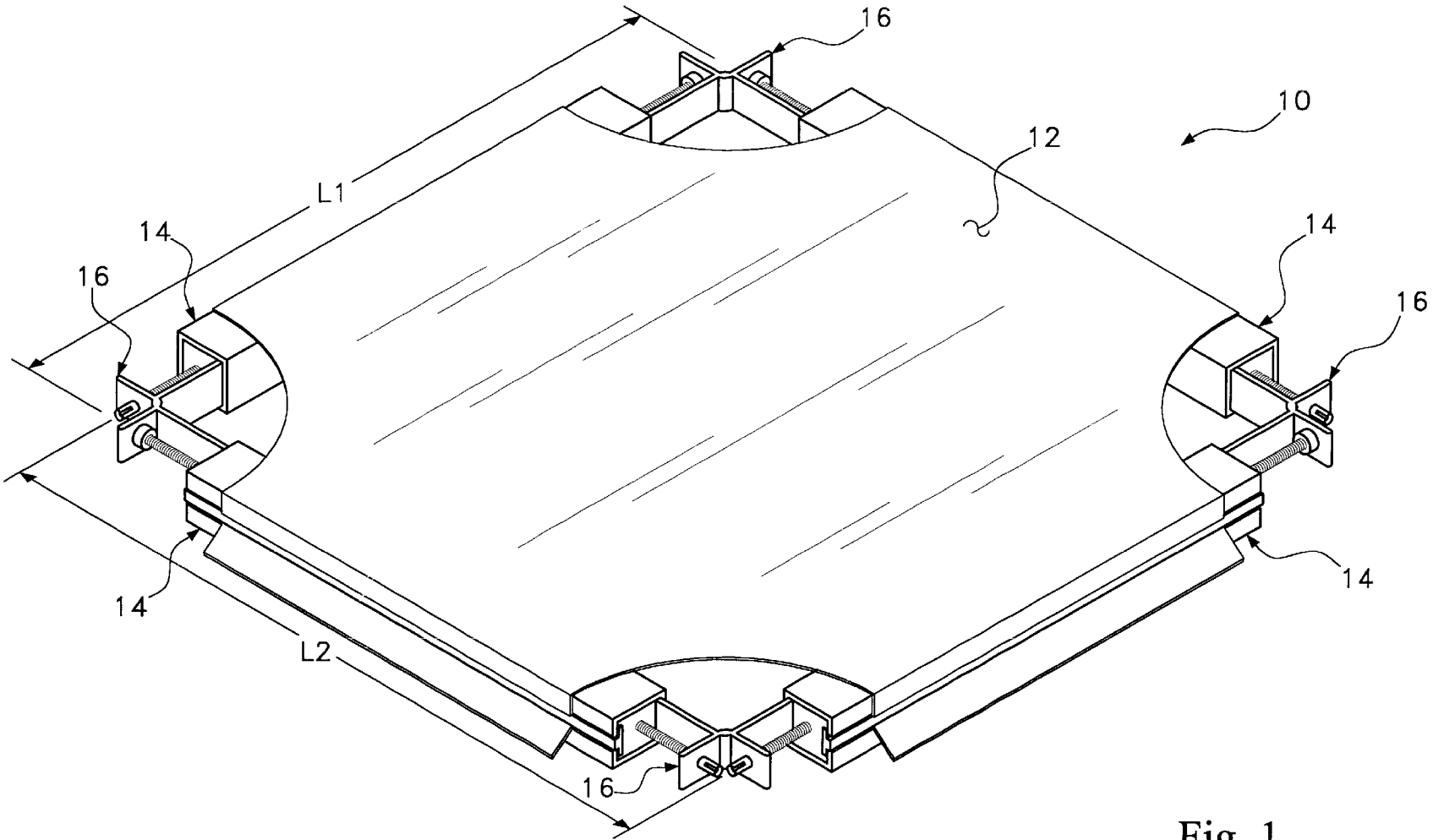
FIG. 1 is a perspective view of a frame device in accordance with the present invention.

Referring to FIG. 1, a frame device 10 is shown. The frame device 10 is being used to hold and tension a silk screen 12 of the type typically used in silk screen printing.

The frame device 10 has four side framing elements 14. The side framing elements 14 are matched in set pairs, wherein the two side framing elements 14 that lay parallel to one another have the same length. However, the side framing elements 14 from adjacent sides of the frame device 10 need not have the same length.

The side framing elements 14 are mechanically interconnected through the use of corner brackets 16. The structure of the corner brackets 16 is later described in detail. In forming the frame assembly 10, the four corner brackets 16 are used. Each corner bracket 16 interconnects two adjacent side framing elements 14. With the corner brackets 16 in place, two sides of the frame assembly 10 have an overall first length L1 and the other two sides of the frame assembly 10 have a second overall frame length L2. As will be later explained, the first length L1 and the second length L2 of the sides of the frame device can be adjusted widely. Accordingly, a single frame assembly 10 can be used to support various silk screens 12 of widely different dimensions.

Figure 2:
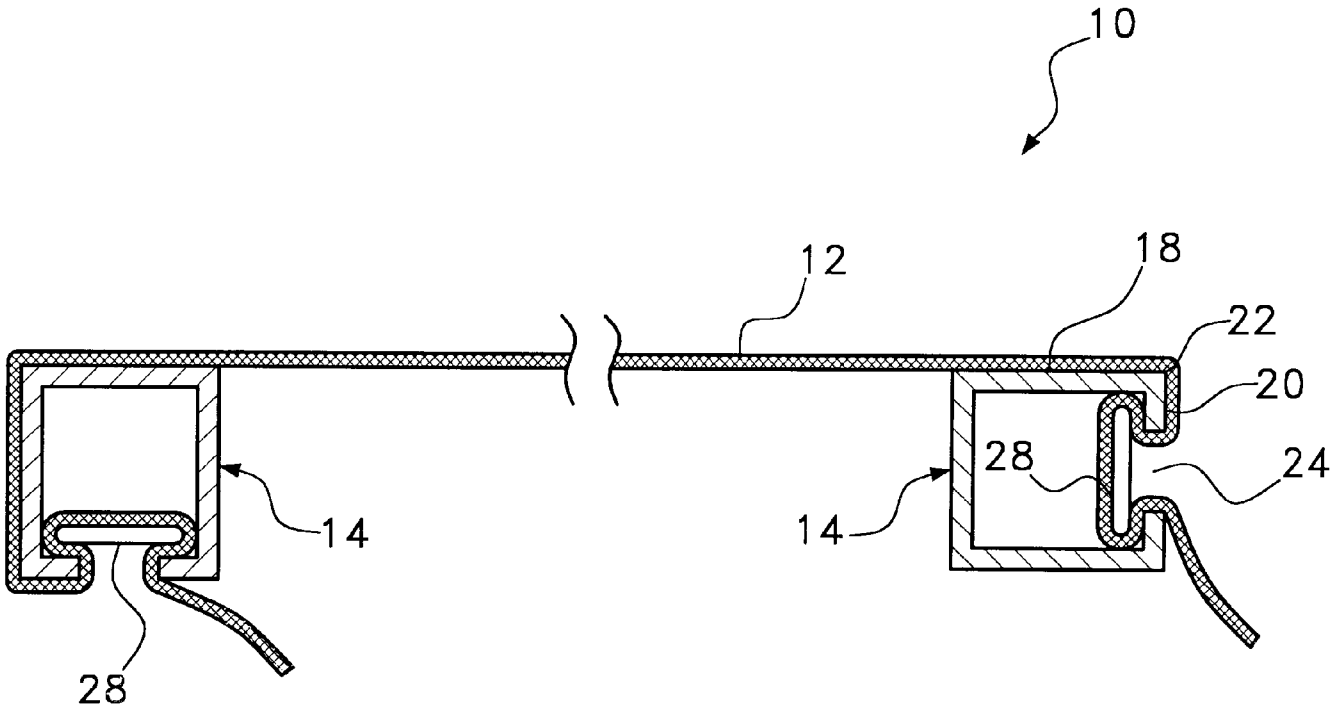
FIG. 2 is a cross-sectional view of the embodiment of FIG. 1, viewed along section line 2—2.

Referring to FIG. 2, it can be seen that each of the side framing elements 14 is tubular. Each side framing element 14 has a flat top surface 18, an outer vertical surface 20 and a straight corner 22 which is the line of demarcation between the top surface 18 and the outer vertical surface 20. As later will be explained, the straight corner 22 may be used as a guide when orienting a silk screen 12 within the frame assembly 10.

The side framing elements 14 are slotted. Depending upon the orientation of the framing elements 14, the slot can be positioned on either the outer vertical surface 20 of the side framing elements 14 or on the bottom of the side framing elements 14. In FIG. 2, two side framing elements 14 are shown. One is oriented with the slot 24 on the side. The other is oriented with the slot on the bottom.

Regardless of the position of the slot 24, the slot 24 communicates with the interior of the side framing element 14. When a silk screen 12 is within the frame assembly 10, the silk screen 12 passes over either one or two of the side surfaces of each of the side framing elements 14. In the right hand side of the shown embodiment, the slot 24 is positioned on the outer vertical surface of the framing element 14. As such, the silk screen 12 passes only over the top surface 18 of the framing element 14. However, on the left hand side of the figure, the framing element 14 is oriented so that the slot 24 is disposed on the bottom of the framing element 14. In such an orientation, the silk screen would pass over the top, the side and along the bottom of the framing element until the silk screen 12 entered the slot 24.

When a silk screen 12 is first prepared, four locking rods 28 are adhered to the silk screen 12. The four locking rods are adhered to the silk screen parallel to the four edges of the silk screen 12. When the silk screen is being mounted in the frame device 10, the locking rods 28 are inserted into the slots 24 of the framing elements 14. The locking rods 28 are therefore adhered to the sections of the silk screen 12 that are looped into the slots 24 of the framing elements 14.

Once the locking rods 28 are adhered to the silk screen 12, the locking rods 28 are slid into the side framing elements 14. The silk screen 12 extending from the locking rods 28 extends through the slot 24 in the framing elements 14. After the locking rods 28 and the silk screen are inserted into the various side framing elements 14, the side framing elements are attached to the corner brackets 16 (FIG. 1) and the framing elements 14 are moved apart, thereby tightening the silk screen 12. As the silk screen 12 is made taut, the locking rods 28 are pulled against the side framing element 14. The silk screen 12 becomes pinched between the locking rods 28 and the side(s) of the framing element 14, thereby becoming locked into place.

The locking rods 28 are adhered directly to the silk screen 12. As such, the locking rods 28 do not move in relation to the silk screen 12. Accordingly, by aligning the locking rods 28 in the slots 24, a silk screen 12 can be removed from the frame device 10 and repeatedly remounted in the exact same orientation. The use of the locking rods 28 therefore serves both as part of the mounting mechanism and as a mounting gauge to ensure that the silk screen 12 is mounted in the same orientation time after time.

Returning to FIG. 1, it can be seen that the four side framing elements 14 of the frame assembly 10 do not directly interconnect. Rather, each end of a side framing element 14 engages a corner bracket 16. It is the corner brackets 16 that mechanically interconnect the four side framing elements 14.

Figure 3:
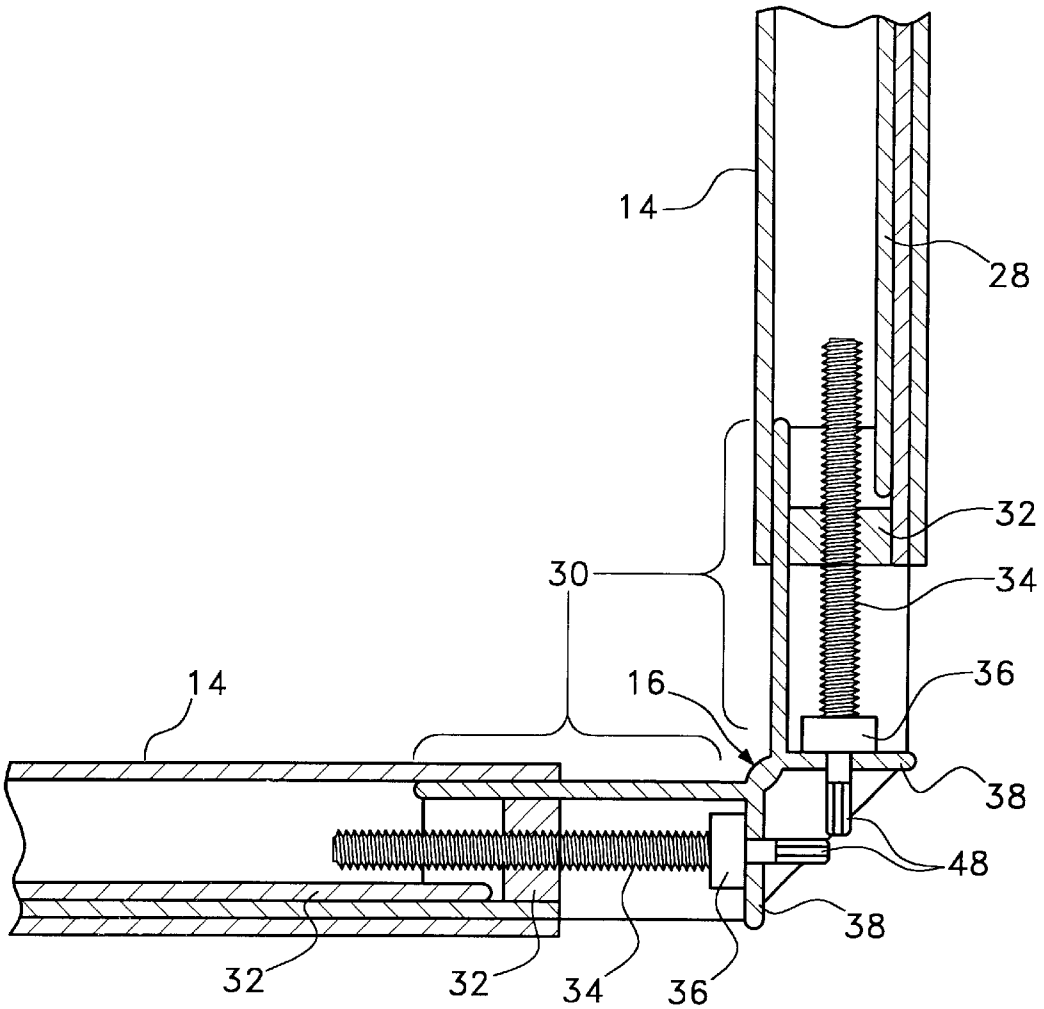
FIG. 3 is a cross-sectional view of a corner segment of the embodiment of FIG. 1, viewed along section line 3—3.

Referring now to FIG. 3, it can be seen that each corner bracket 16 is comprised of two slide sections 30 that are joined together at a perpendicular. In the shown embodiment, each of the slide sections 30 has an L-shaped cross-section. The slide sections 30 of the corner brackets 16 slide into the ends of adjacent side framing elements 14, thereby joining the side framing elements 14 and orienting the side framing elements 14 at a perpendicular.

At the ends of each of the side framing elements 14 is positioned a threaded block 32. The threaded block 32 defines a central aperture that is threaded. A threaded block 32 is supported in the center of each side framing element 14 near each of its ends. Spaces exist around the threaded block 32 that enable the slide sections 30 of the corner brackets 14 and the locking rod 28 to move.

A specialized threaded adjustment screw 34 engages the threaded block 32 at both ends of each of the side framing elements 14. Each adjustment screw 34 has a head section 36 that abuts against an end stop wall 38 at the end of the slide section 30 of the corner bracket 14. An engagement head 48 extends above the head section 36 of the adjustment screw 34. The engagement head 48 extends through an aperture in the end stop wall 38. The engagement head 48 extends-past the slide section 30 of the corner bracket 16 and provides a point by which the adjustment screw 34 can be manually rotated. In the shown embodiment, the engagement head 48 is shaped as a hex-nut that can be turned by a nut driver. In alternate embodiments, the engagement head can be slotted to receive a screwdriver or manual turn handles can be attached to each engagement head.

As the adjustment screws 34 are turned, the length of the adjustment screws 34 between the end stop walls 38 of the corner bracket 16 and the threaded block 32 in the side framing element 14 changes. Accordingly, the degree by which the slide section 30 of the corner bracket 16 enters the side framing element 14 also changes. As the slide sections 30 of the corner brackets 16 move in relation to the side framing elements 14, the overall length L1, L2 (FIG. 1) of the sides of the framing assembly 10 change.

Referring back to FIG. 1, it will now be understood that to utilize the present invention frame assembly 10, a silk screen 12 is connected to the four side framing elements 14. The side framing elements 14 are then attached to the four corner brackets 16. Once the framing elements 14 are attached to the corner brackets 16, the adjustment screws 34 at the corner brackets 16 are turned to make the frame assembly 10 longer and wider. The lengths L1, L2 of each of the four sides of the frame assembly 10 can be independently adjusted. The lengths L1, L2 of the sides of the frame assembly 10 are adjusted until the silk screen 12 is taut and ready for use.

Figure 4:
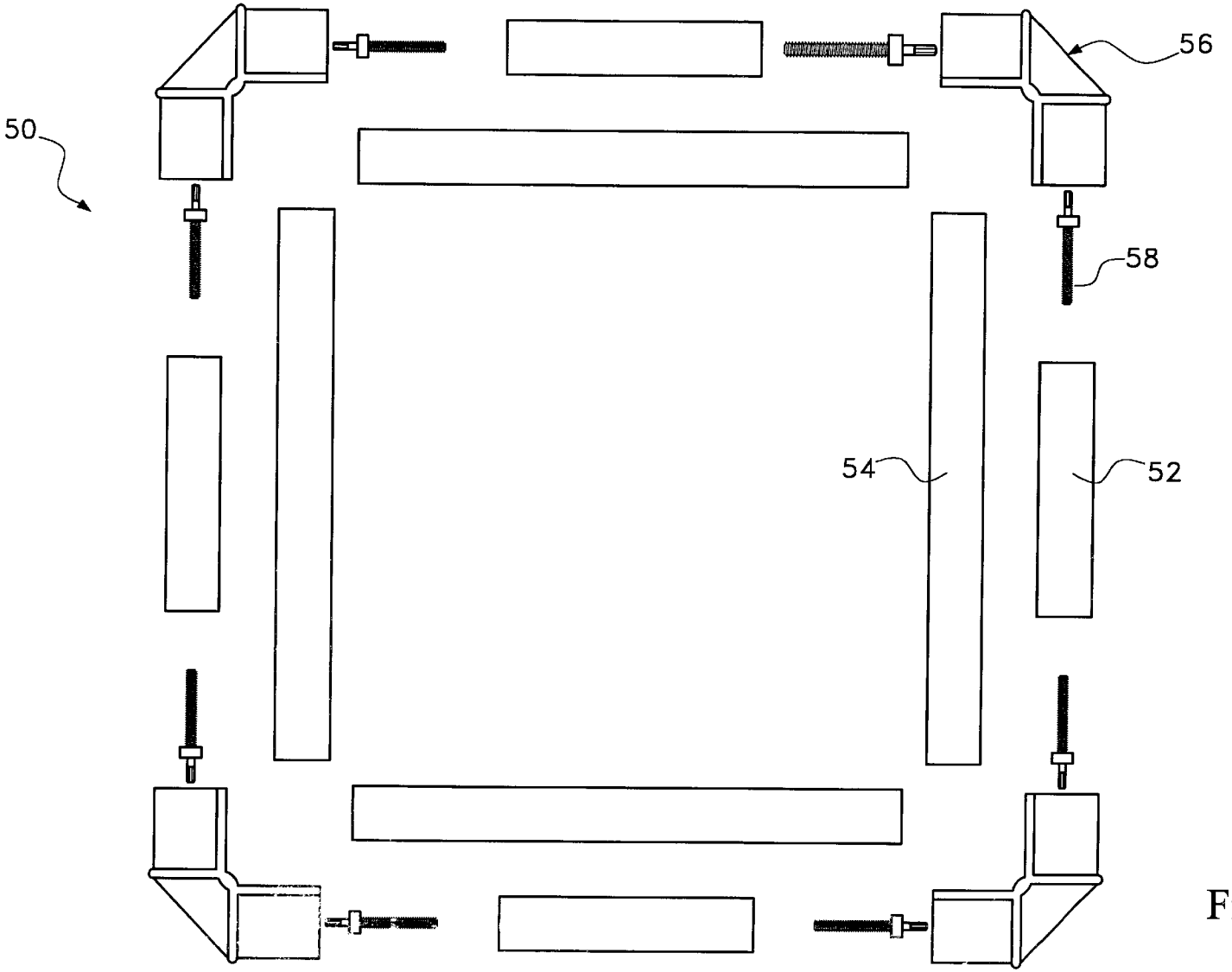
FIG. 4 is a top view of the present invention showing multiple modular framing elements.

Since the construction of the present invention frame assembly is modular, having separate side framing elements and separate corner brackets, it will be understood that the length of the various modular components can be altered to suit a specific need. Referring to FIG. 4, it can be seen that the present invention frame assembly 50 can be manufactured and sold with numerous different sets of side framing elements 52, 54, each having a different length. Accordingly, the length and the width of the frame assembly 50 can be widely adjusted by using different sized side framing elements 52, 54. The corner brackets 56 and the adjustment screws 58 remain constant and can be used with any of the side framing elements 52, 54 regardless of their size.

It will be understood that the various figures described above illustrate only one exemplary embodiment of the present invention. A person skilled in the art can make numerous alterations and modifications to the shown embodiment that functions in an equivalent manner to the embodiment shown and described. For example, the cross sectional shape of the corner brackets and the cross sectional shape of the side framing elements can be altered. What is important is that the corner brackets freely pass into the side framing elements and are free to move when adjusted by the adjustment screws. All such modifications are intended to be included within the scope of the present invention as defined by the appended claims.

What is claimed is:

1. A frame assembly for use in supporting a silk screen, said assembly comprising:

four corner brackets, each corner bracket having two perpendicular arms, wherein each perpendicular arm has an end wall that defines a central aperture and at least one slide section that extends from said end wall;

four tubular framing elements, each said tubular framing element having two ends and a threaded block that partially obstructs each of said ends, wherein spaces exist about each threaded block that enable said at least one slide section of a corner bracket to pass therethrough;

wherein each of said ends of the framing elements receives one of said arms from the corner brackets, thereby enabling each of said four corner brackets to engage two of said framing elements and to orient those framing elements at a perpendicular; and eight adjustment screws, each adjustment screw having a head section, a threaded shaft that extends from one side of said head section and an engagement element that extends from said head section opposite said threaded shaft, wherein each said adjustment screw engages one of said framing elements and one of said corner brackets so that said threaded shaft of said adjustment screw engages said threaded block in said framing element, said head section of said adjustment screw abuts against said end wall in said corner bracket, and said extension element of said adjustment screw extends through said central aperture in said end wall of said corner bracket.

2. The assembly according to claim 1, wherein each of said framing elements has a connection mechanism disposed therein that enables each of said framing elements to engage and retain a segment of a silk screen.

3. The assembly according to claim 1, wherein each said adjustment screw biases said arm of one of said corner brackets out of one of said framing elements when turned.

4. The assembly according to claim 1, wherein each of said framing elements has a flat top surface and a vertical side surface that are perpendicular to each other and join along a common straight corner.

5. The assembly according to claim 4, wherein a slot is formed in said vertical side of each of said framing elements that extends across the length of each framing element.

6. The assembly according to claim 5, further including a locking rod positionable within each of said framing elements, wherein said locking rod operates in unison with the slot in said framing elements to form a connection mechanism capable of engaging and retaining a section of a silk screen.

7. The assembly according to claim 6, wherein said locking rods are adhered to the silk screen.

8. The assembly according to claim 1, wherein said framing elements come in sets of different lengths, thereby enabling said frame to be configured into a plurality of different lengths and widths.

9. The assembly according to claim 1, wherein each of said adjustment screws adjusts how deep said at least one slide section from one of said corner brackets is received within an end of one of said framing elements.

* * * * *